US005080517A

United States Patent [19]

Lynn

[11] Patent Number: 5,080,517

[45] Date of Patent: Jan. 14, 1992

[54] MOP ASSEMBLY FOR APPLYING CLEAN LIQUIDS AND REMOVING DIRTY LIQUIDS

[76] Inventor: William R. Lynn, 38 Prospect St., Dover, N.H. 03820

[21] Appl. No.: 564,031

[22] Filed: Aug. 7, 1990

[51] Int. Cl.[5] ..... A47L 13/26

[52] U.S. Cl. ..... 401/13; 15/119 R; 15/118; 401/268

[58] Field of Search ..... 15/116.1, 116.2, 119 R, 15/119 A, 118; 401/13, 268, 172

[56] References Cited

U.S. PATENT DOCUMENTS

| | | | |
|---|---|---|---|
| 397,521 | 2/1889 | Rourke | 15/119 R |
| 1,685,731 | 9/1928 | Trevena | 401/172 X |
| 2,010,795 | 8/1935 | Balinger | 15/119 R |
| 2,642,605 | 6/1953 | Ray | 15/118 X |
| 2,834,036 | 5/1958 | Shannon | 15/119 A |
| 3,065,493 | 11/1962 | Niver | 401/13 |
| 3,661,467 | 5/1972 | Dalton | 401/13 X |

FOREIGN PATENT DOCUMENTS

| | | | |
|---|---|---|---|
| 31112 | 7/1981 | European Pat. Off. | 15/119 A |
| 616158 | 6/1961 | Italy | 401/13 |
| 298085 | 7/1954 | Switzerland | 15/116.2 |
| 1139009 | 1/1969 | United Kingdom | 15/118 |

*Primary Examiner*—Danton D. DeMille
*Attorney, Agent, or Firm*—Davis, Bujold & Streck

[57] ABSTRACT

A mop for removing waste liquid from a surface to be cleaned, the mop comprising a handle, a container means, for receiving liquid from the surface to be cleaned, being pivotable connected by a first pivot to one end of the handle, a first pad, having a cleaning surface, mounted on a first surface of the container, the cleaning surface being adapted for removing and retaining liquid from the surface to be cleaned upon contact therewith, the container being pivotable about the first pivot from a first stationary position, in which the first pad is located adjacent the surface to be cleaned, to a second stationary position, in which the first pad is located remote from the surface to be cleaned, for removal of liquid retained by the cleaning surface, and a wringing device, carried by the mop, for wringing waste liquid from the cleaning surface into the container when in the second position.

19 Claims, 3 Drawing Sheets

MOP ASSEMBLY FOR APPLYING CLEAN LIQUIDS AND REMOVING DIRTY LIQUIDS

BACKGROUND OF THE INVENTION

1. Field of the Invention

In general the present invention relates to a mop for brushing, scrubbing and general cleaning, and more specifically to a mop which provides a self wringing, renewable wiping surface without the need for handling of the mop head by the operator via controls which may be operated from the mop handle. Provision is also made for applying a cleaning liquid to the surface from a self contained reservoir.

2. Description of the Prior Art

The advantages of a mop head which is self wringing and which can apply a cleaning liquid are well recognized, and many inventions for mops are directed to that end. U.S. Pat. No. 3,727,259 patented by F. Wilson on Apr. 17, 1973, for example, provides a mop having a sponge at the front end of a handle, flanked by a pair of pinch rollers. The cleaning surface of the sponge which contacts the surface to be cleaned is forward of the pinch rollers. When it is desired that waste liquid be squeegeed from the sponge, the front end of the mop is held over a bucket, sink or other receptacle, and the sponge is drawn by a hook toward the handle between the two rollers so that the sponge is squeezed at the sides progressively from the back, forcing the waste liquid through the front cleaning surface of the sponge, into the receptacle.

In the apparatus above, waste liquid is forced from the sponge so that it may be used to apply a clean liquid, although the front of the sponge remains partly contaminated by waste liquid expelled through it U.S. Pat. No. 4,119,386 issued Oct. 10, 1978, to E. Cushing discloses a mop having a handle and a head attached to the lower end of the handle. A reservoir for liquid surrounds a portion of the handle which extends centrally through the tank. A flexible conduit is connected between the tank and mop head for distributing liquid from the tank to a floor area by passing through a plate to the upper surface of a pad. The fluid diffuses through the pad onto the floor surface to be treated.

This apparatus, therefore, continually flushes through the pad from behind. It is not designed, however, to remove waste fluid from the floor, and contamination can therefore build up.

U.S. Pat. No. 4,926,515 issued May 22, 1990, to W. R. Lynn & R. R. Belanger describes a self wringing mop assembly which includes a handle, a mop head connected to one end of the handle, and means for containing a dispensable liquid being attached to the handle for applying fresh liquid to the surface to be cleaned. Rotatable absorbent means, such as an endless belt, contacts the floor surface as the mop moves thereacross and absorbs liquid from the surface to be cleaned. The liquid is removed by a friction roller and collected in a separate storage reservoir.

SUMMARY OF THE INVENTION

It is an object of the invention to provide a mop assembly which is self wringing for removing waste liquid from the cleaning surface.

It is another object of the invention to provide a self wringing mop assembly with integral collection and storage means for the wrung waste liquid.

It is another object of the invention to provide a self wringing mop assembly with a plurality of renewable surfaces that can be independently wrung.

Another object is to provide a self wringing mop assembly in which the plurality of renewable, independently wrung surfaces are independently replaceable.

It is another object of the invention to provide a self wringing mop assembly, having the above advantages, which is entirely operable from the handle.

Yet another object is to provide a self wringing mop having many of the above advantages which includes means for squeegeeing the surface to be cleaned and in which the squeegee surface can be adjusted to various angles with respect to the surface to be cleaned.

Still another object is to provide the above self wringing mop in which pressure roller means is provided for said wringing.

Additional objects and advantages will become apparent from the following description and drawings.

Briefly the invention comprises a mop for removing waste liquid from a surface to be cleaned, said mop comprising a handle, container means, for receiving liquid from the surface to be cleaned, being pivotable connected by first pivot means to one end of the handle, first pad means, having a cleaning surface, mounted on a first surface of said container means, said cleaning surface being adapted for removing and retaining liquid from the surface to be cleaned upon contact therewith, said container means being pivotable about said first pivot from a first stationary position, in which said first pad means is located adjacent the surface to be cleaned, to a second stationary position, in which said first pad means is located remote from the surface to be cleaned, for removal of liquid retained by said cleaning surface, and wringing means, carried by said mop, for wringing waste liquid from the cleaning surface into said container when in the second position.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
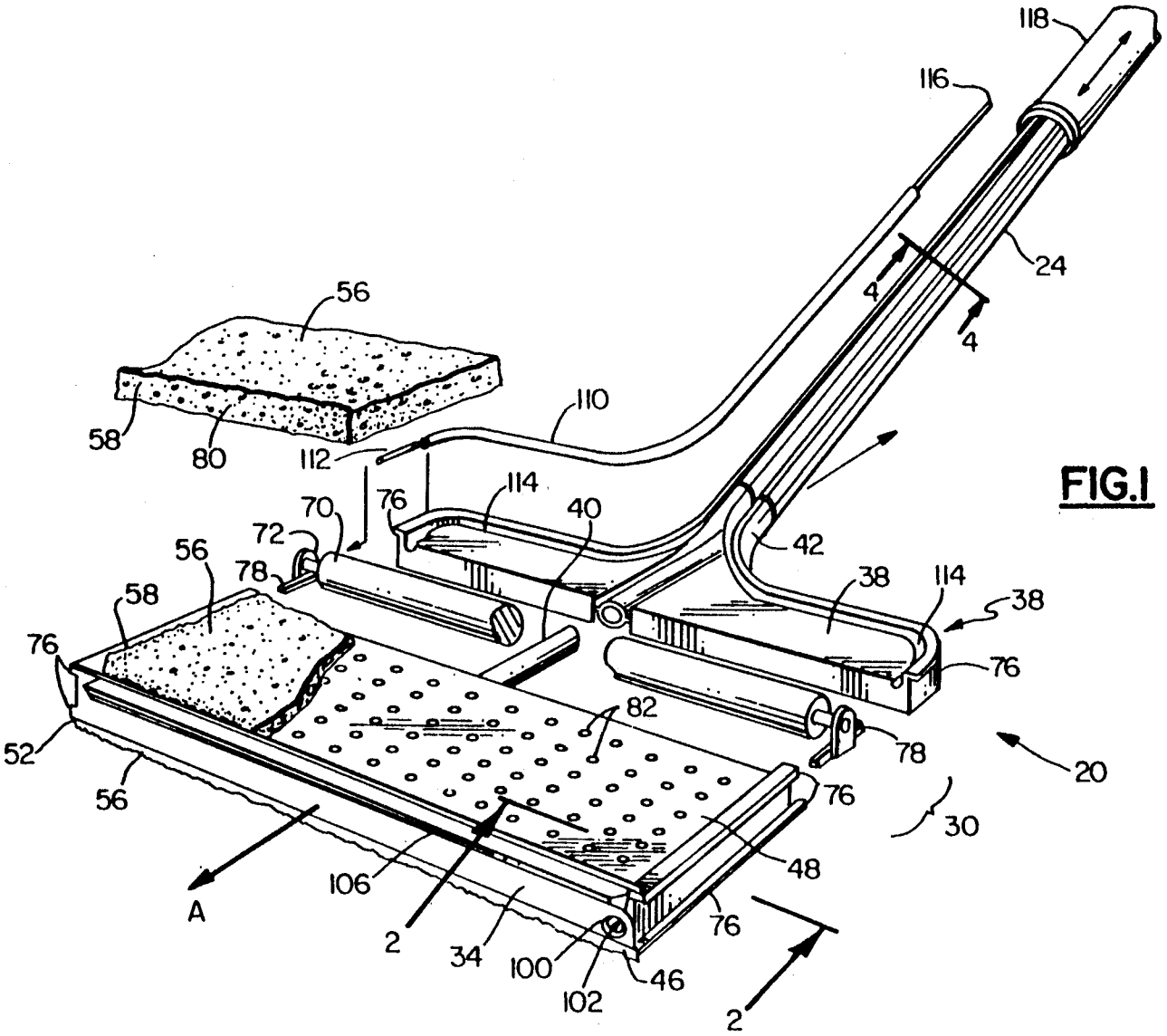
FIG. 1 is an exploded perspective view of the mop apparatus according to a preferred embodiment of the invention.

Before explaining the invention in detail, it is to be understood that the invention is not limited in its application to the detail of construction and arrangement of the parts illustrated in the drawings since the invention is capable of other embodiments and of being practiced or carried out in various ways. It is also to be understood that the phraseology or terminology employed is for the purpose of description only and not of limitation.

Referring to FIG. 1, the mop 20 includes a handle 24 and a mop head 30, consisting of a base 38 and container means 34. The container means 34 of mop head 30, having first and second surfaces, is connected to the base 38 of the mop head 30 by a pivot shaft 40, the rotational axis A of which extends generally axially from the lower end of handle 24. The shaft 40 is secured to the base 38 by releasable locking means (not shown) which allow the shaft 40 to pivot with respect to the base 38.

The handle 24 is pivotable about a releasable fastening pin (second pivot means) 42 and it can be locked at any desired angle with respect to base 38.

The container means 34 is preferably rotated to either one of two stationary positions so that the first surface 46 or second surface 48 is positionable adjacent the surface to be cleaned. Mounted on the first surface 46 is a replaceable first pad 52 having cleaning surface 56 facing toward the surface to be cleaned.

The second surface 48 of the container means is also designed to receive a replaceable second pad 58, part of which is shown partially suspended above the mop for the purpose of illustration. The cleaning surface 56 of the second pad 58, which is shown facing up in FIG. 1, may be rough and hard in nature or smooth and soft, depending on the application. The pad is preferably absorbent so that the cleaning surface 56 can be used to apply fresh or draw waste liquid by absorption from the surface to be cleaned. Preferably both pads are different from one another although this is not required for proper operation of the mop.

Figure 2:
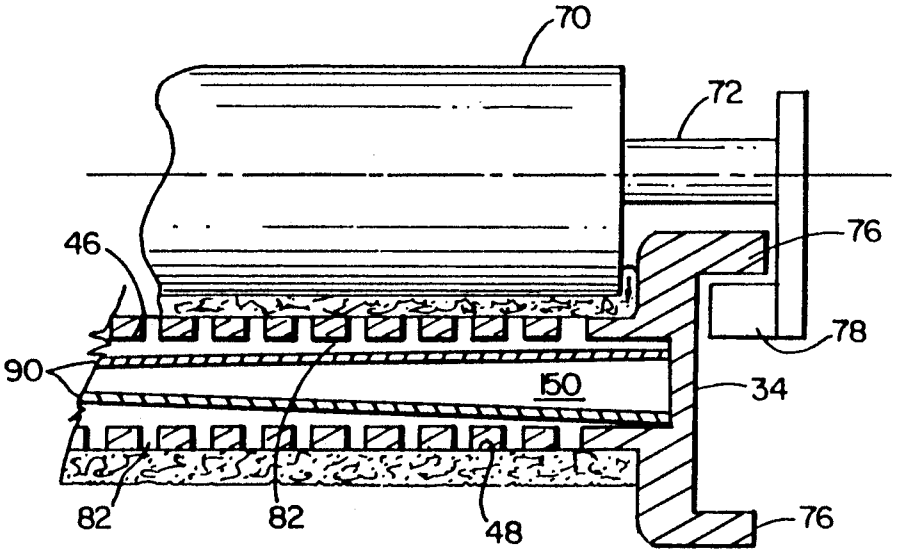
FIG. 2 is a partial cross sectional view of the apparatus shown in FIG. 1, along section line 2—2.

Referring to FIGS. 1 and 2, a wringing pressure device 70, which rotates on shaft 72, slides along tracks 76 by means of guide shoes 78. The shoes 78 hold squeegee 70 in intimate contact with the cleaning surface 56 for forcing the absorbed waste liquid from the cleaning surface through a rear surface 80 of the pad and into the container means 34. The waste liquid is directed into a central cavity 150 of the container means by way of a plurality of openings 82 provided in the first and second surfaces 46, 48 and a funnel member 90 associated therewith.

Figure 3:
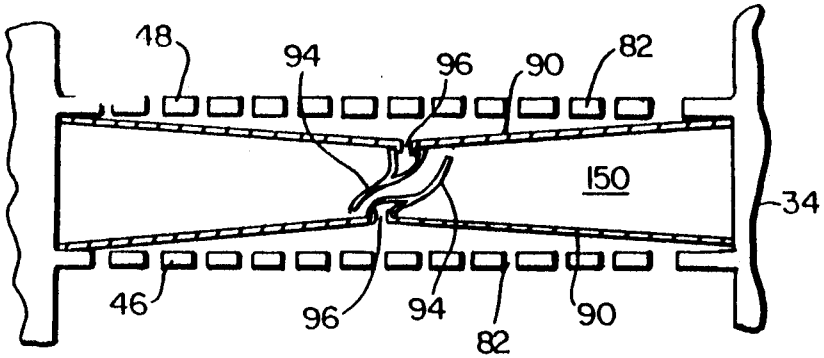
FIG. 3 is a schematic view of a portion of another embodiment of the invention.

The two opposed funnel members 90, as can be seen in FIG. 3, each have an opening 96 and the two openings are preferably offset from one another. This ensures that the liquid which is removed from the wrung pad does not flow directly through both openings 96 back on to the surface being cleaned. In addition, the openings are provided with an inwardly extending extension member (not numbered) which forms a dam and prevents the waste liquid from flowing back out through the opening 96 once a sufficient quantity of liquid has collected within the container means 34. If desired, a tubing or conduit 94 may be attached to the extension member to channel further the water away from the opening 96.

The container means 34 may be emptied by a variety of means known to the art such as through drain 100 which is releasably sealed by screw cap means 102, and this is shown in the lower right hand corner of the container means 34 in FIG. 1.

In another embodiment of the invention, the squeegeed waste liquid is delivered to a container means which is part of base 38, instead of being collected in the pivoted section. In this embodiment, when the pivoted section which supports the pads are squeegeed the liquid is delivered by conduit means, such as a flexible tube provided through shaft 40, to the container supported by the base 38. One skilled in the art will be readily able to construct this embodiment from the present description and drawings.

A floor squeegee 106 is provided on the front of the container means 34 and it can be utilized by rotating the mop 180° via the handle to take advantage of the tilt of the handle with respect to the base. Alternatively, squeegee 106 is applied by, rotating container means 34 so that the squeegee is at the lower portion of the head, and adjusting the angle of the head with respect to the floor by pivoting handle 24 with respect to the base 38 to a convenient angle.

The angle of floor squeegee 106 with respect to the container 34 may also be adjustable if desired.

Figure 4:
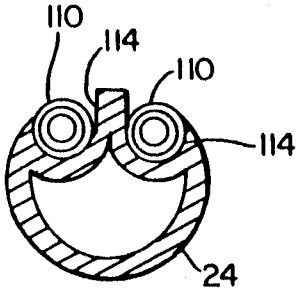
FIG. 4 is a cross sectional view of the handle of the apparatus shown in FIG. 1, along section line 4—4.

Referring now to FIGS. 1 and 4, one end 112 of a flexible cable encased in a flexible sheath is attached to one of the shoes 78 for traversing the wringing device 70 over cleaning surface 56. The sheath/cable 110 is recessed within a slot 114 of the handle and connected at a second end 116 to a tubular grip 118 which is slidable along the handle 24 to wring one of the cleaning surfaces. Preferably a second sheath/cable 110 is attached to the other shoe so that a balanced force is applied to each end of the wringing device 70.

Detents or spring stops (not shown) may be provided on the handle 24 to limit up and down sliding travel of the grip 118. As the grip 118 moves away from the base 38, it draws the shoes 78, guided by tracks 76, fully back onto base 38 so that the container means 34 can be rotated freely without obstruction by the wringing assembly. In a biased stable center position of the grip 118, the shoe 78 is placed in a bridging position across both the container means 34 and the base 38 to the prevent container means 34 from rotating. Movement of the grip 118 toward the base 38 causes the wringing device 70 to rotate over the pad 58 and wring the same.

During wringing, the mop head is preferably rested on the floor or another flat surface and this assists with keeping the tracks of the container means and the base aligned, although a pin or other manual or automatic locking mechanism, that may be activated by the wringing device, could be provided between the container means and the base for that purpose.

Figure 5:
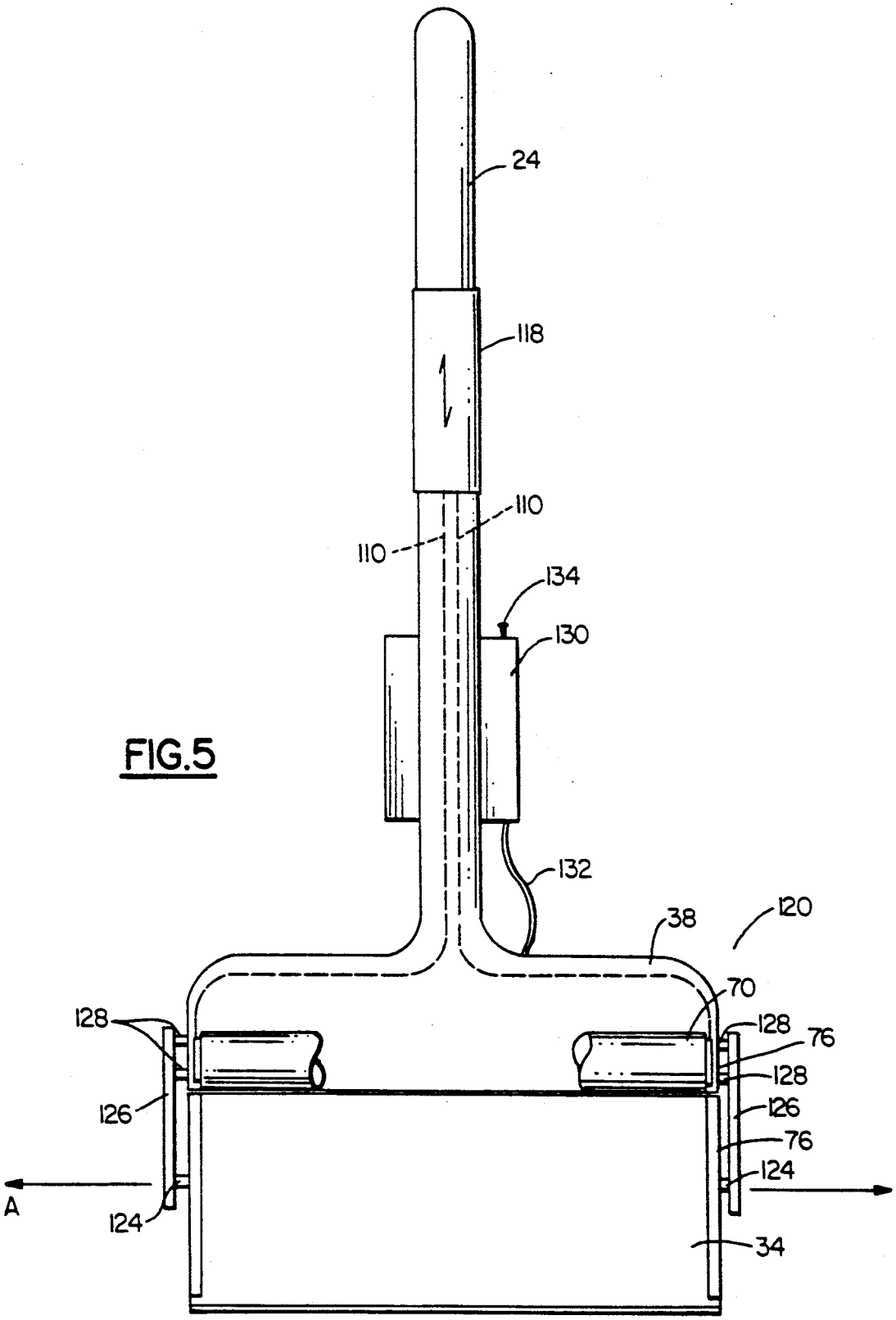
FIG. 5 is a schematic view of another embodiment of the invention.

In a second embodiment shown in FIG. 5, the container means 34 of the mop 120 rotates on a pair of pivots 124, the rotational axis A of which is generally transverse to the axis of the handle 24. The pivots 124 are supported by a bracket 126 which is rigidly mounted by mounting members 128 to the base 38.

A reservoir 130, which contains a cleaning liquid such as water, a soap solution, or a solvent, delivers the cleaning liquid by way of tube 132 to openings in base 38 (not shown), to other convenient liquid distribution means, or directly to the floor or other surface to be cleaned. The control of the flow of liquid through tube 132 is provided by a conventional hand control valve 134. In this embodiment, it is also anticipated that the pressure device 70, which slides along tracks 76 by means of shoes 78, will be used to prevent undesired pivoting of the container means.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

What is claimed is:

1. A mop for removing waste liquid from a surface to be cleaned, said mop comprising:

a handle, container means, for receiving liquid from the surface to be cleaned, being pivotably connected by first pivot means to one end of the handle, first pad means, having a cleaning surface, mounted on a first surface of said container means, said cleaning surface of said first pad means being adapted for removing and retaining liquid from the surface to be cleaned upon contact therewith, second pad means, having a cleaning surface, mounted on a second surface of said container means remote from said first surface, said cleaning surface of said second pad means being adapted for removing and retaining liquid from the surface to be cleaned upon contact therewith, said container means being pivotable about said first pivot from a first stationary position, in which said first pad means is located adjacent the surface to be cleaned, to a second stationary position, in which said first pad means is located remote from the surface to be cleaned, for removal of liquid retained by said cleaning surface of said first pad means, and said second pad means is located adjacent the surface to be cleaned, said first and second surfaces of said container means each have at least one opening therein for providing access of waste liquid wrung from a said cleaning surface into said container means, and wringing means, carried by said mop, for wringing waste liquid from either one of said cleaning surfaces into said container when a said one of said cleansing surfaces is located remote from the surface to be cleaned.

2. A mop according to claim 1, wherein said wringing means, in a stable center position, engages both said handle and said container means and prevents undesired pivoting movement of said container means from said first position to said second position about said first pivot means.

3. A mop according to claim 2, wherein said handle defines an axis and the axis of said first pivot means is generally transverse to the axis of said handle.

4. A mop according to claim 3, further comprising a mop head and means for interconnecting said container means to said one end of said handle, and second pivot means carried by said mop head for changing the angle of said handle with respect to said mop head.

5. A mop according to claim 2, the axis of said first pivot means extends generally axially from one end of said handle.

6. A mop according to claim 5, further comprising a mop head and means for interconnecting said container means to said one end of said handle, and second pivot means carried by said mop head for changing the angle of said handle with respect to said mop head.

7. A mop according to claim 1, wherein funnel means is provided adjacent said at least one opening of each of said first and second surfaces for channeling the waste liquid into a central cavity of the container means through a central opening.

8. A mop according to claim 7, wherein conduit means extends from said central opening into said central cavity so that liquid received in said container means by way of said opening is prevented from exiting.

9. A mop according to claim 1, wherein said wringing means comprises a pressure roller, and means, mounted on a mop head attached to the one end of said handle and carrying the first pivot means, for traversing said pressure roller in intimate contact over a said cleaning surface when it is in said second stationary position for forcing the waste liquid therefrom into said container means.

10. A mop according to claim 9, wherein said means for traversing said pressure roller means in intimate contact over said cleaning surface comprises grip means support by said handle interconnected by cable means with said pressure roller means.

11. A mop according to claim 10, wherein when said pressure roller means is moved out of its central stable position onto said mop head by said grip means, unobstructed pivoting rotation of said container means can occur.

12. A mop according to claim 9, further comprising:

a reservoir, for containing a cleaning liquid, is mounted on said handle, and liquid delivery means connected to said reservoir and mounted on said mop head for delivering the cleaning liquid to the surface to be cleaned.

13. A mop according to claim 1, wherein drainage means is provided for removing liquid from said container means.

14. A mop for removing waste liquid from a surface to be cleaned, said mop comprising:

a handle, container means, for receiving liquid from the surface to be cleaned, being pivotably connected by pivot means to one end of the handle, pad means, having a cleaning surface, mounted on a first surface of said container means, said pad means being adapted for removing and retaining liquid from the surface to be cleaned upon contact therewith, said container means being pivotable about said pivot from a stationary first position, in which said pad means is located adjacent the surface to be cleaned, to a stationary second position, in which said pad means is located remote from the surface to be cleaned, for removal of liquid retained by said pad means, said first surface of said container means having at least one opening therein for providing access of the waste liquid wrung from said pad means into said container means, and wringing means, carried by said mop, for wringing waste liquid from said pad means into said container means when said container means is in the second position, wherein said container means is solely a container for storing waste liquid wrung from said pad means and said container means is provided with means for preventing substantially all of the waste liquid, removed from said pad means when said container means is in the second position, from flowing back through said at least one opening onto said pad means even when said container means is moved to the first position, said wringing means comprises a pressure roller and a grip support by said handle interconnected by at least one cable with said pressure roller for traversing said pressure roller in intimate contact over said pad means when said container means is in said second position for forcing the waste liquid from said pad means into said container means.

15. A mop according to claim 14, wherein funnel means is provided adjacent said at last one opening of said first surface for channeling the waste liquid into a central cavity of the container means through a central opening.

16. A mop according to claim 15, wherein a conduit extends from said central opening into said central cavity so that liquid received in said container means by way of said at least one opening is prevented from exiting.

17. A mop according to claim 14, wherein when said pressure roller is moved out of a central stable position onto said mop head by said grip, unobstructed pivoting rotation of said container means can occur.

18. A mop according to claim 14, further comprising:

a reservoir, for containing fresh cleaning liquid, is mounted on said handle, and liquid delivery means, connected to said reservoir, is provided for delivering the cleaning liquid from said reservoir to the surface to be cleaned.

19. A mop according to claim 14, wherein said at least one opening in the first surface funnels waste water into the container means through a conduit which empties into the container means adjacent a second surface of said container means remote for the first surface.

* * * * *